United States Patent [19]

Bartlett

[11] Patent Number: 5,039,097

[45] Date of Patent: Aug. 13, 1991

[54] SNAP-ON WEIGHT FOR A TENNIS RACKET

[76] Inventor: William L. Bartlett, 614 Santa Barbara St., Santa Barbara, Calif. 93101

[21] Appl. No.: 508,984

[22] Filed: Apr. 12, 1990

[51] Int. Cl.[5] ..... A23B 49/04

[52] U.S. Cl. ..... 273/73 R

[58] Field of Search ..... 273/73 R, 73 D, 73 E, 273/73 C

[56] References Cited

U.S. PATENT DOCUMENTS

| | | | |
|---|---|---|---|
| 4,476,590 | 10/1987 | Krent et al. | 273/73 R |
| 4,761,007 | 8/1988 | Boschian | 273/73 D |
| 4,927,143 | 5/1990 | Hillock | 273/73 D |

FOREIGN PATENT DOCUMENTS

| | | | |
|---|---|---|---|
| 3443009 | 5/1986 | Fed. Rep. of Germany | 273/73 D |
| 3504137 | 8/1986 | Fed. Rep. of Germany | 273/73 D |
| 1398833 | 4/1965 | France | 273/73 D |
| 2554723 | 5/1985 | France | 273/73 D |
| 2135588 | 9/1984 | United Kingdom | 273/73 D |

*Primary Examiner*—Edward M. Coven
*Assistant Examiner*—William E. Stoll
*Attorney, Agent, or Firm*—David O'Reilly

[57] ABSTRACT

A snap-on weight for varying the weight or balance, particularly in the head of a tennis racket to increase power and control. The weight is secured with a weight holder or clip to the frame of the racket. In one embodiment the holder has a socket for receiving the interchangeable weights. The weight is held in the racket by clips formed on the holder engaging adjacent strings or by being clipped on the frame between adjacent strings.

7 Claims, 2 Drawing Sheets

SNAP-ON WEIGHT FOR A TENNIS RACKET

FIELD OF THE INVENTION

This invention relates to a variable weight for tennis rackets or the like to change the swing force and impact center known as the "sweet spot" on a tennis racket and more particularly relates to a snap-on weight that can be easily attached or removed.

BACKGROUND OF THE INVENTION

All players have different swings and control of the racket although the swing fundamentals are the same. The intent is to make as square an impact with the ball as possible with the ball impacting as close as possible to the center of the tennis racket head known as the "sweet spot". But, size, weight, height, strength and other physical factors cause different players to alter the fundamental swing slightly causing "miss-hits" which in turn cause errors in the flight of the ball. A miss-hit, such as contacting the ball near the frame of the racket, will cause the ball to go in the direction different than where it is intended when the player swings.

The above problems can be caused not by a defect in the racket which certainly can contribute to the problem but any minor defect in the players swing. Thus even though the players swing appears to be fundamentally sound even a slightly off line swing, due to for example a weakness in a wrist, forearm, legs or whatever can cause a miss-hit.

It has been found that a player who has a swing that is close to fundamentally sound can improve their swing by slightly changing the balance of the racket head. Greater Weight on certain areas of the racket head can increase the force at which the player can hit the ball. Thus, even the best players can benefit from variations or increases of the weight of the tennis racket head.

When a tennis player strikes the ball he seeks to achieve as much control as possible with the greatest force applied to the ball. This occurs when the ball is struck at a position on the strings known as the "sweet spot" which is the central area of the strings. Also, a player attempts to hit the ball squarely with the racket head normal to the direction of flight of the ball. No two players have identical swings and therefore two different players may swing slightly different with the same racket. Further, since the tennis racket weight and overall structure is fixed after its made, the only way to achieve a different arrangement is to obtain a racket having a different weight or weight distribution. It would, however, be advantageous if weights could be easily added at selected points of the racket that would improve a players overall swing. Selected weighting could be used to not only increase the head weight for a more powerful serve but also to correct for imbalances in a players swing.

A small weight or weights added around the perimeter of the frame, forming the tennis racket head, can result in a swing that is normally slightly off the impact center, being now "on" improving accuracy and power which increases the speed and control of the ball. One such method of adding weight is by tape on the inside surface of the frame. However a disadvantage of this method is that it must be done when re-stringing the racket and the weight cannot be repositioned without removing and replacing the strings.

It is, therefore, one object of the present invention to provide a snap-on weight for tennis rackets that allows a player to vary the weight distribution of a tennis racket. The position of the weight can be changed at will.

Yet another object of the present invention is to provide a snap-on weight for tennis rackets in which the amount of weight can be easily varied.

Yet another object of the present invention is to provide a snap-on weight having flanges for quickly and cleanly attaching the weight to the strings of the racket where they attach to the frame of the tennis racket head.

Still another object of the present invention is to provide a resilient snap-on weight for tennis rackets that can be used in selected sizes to vary the amount and distribution of weight on the tennis racket head.

BRIEF DESCRIPTION OF THE INVENTION

The purpose of the present invention is to provide a snap-on weight for a tennis racket, or the like that allow a player to easily vary the amount and distribution of weight of the tennis racket head. The present invention provides weights in the form of snap-on weighted clips that conveniently attach to the strings or frame of the racket head at selected positions around the racket.

A snap-on weight according to the invention has a weight holder having a crown with slots at either end of an oblong portion terminating in bores that are approximately equal to the diameter to of strings of most tennis rackets. The length of the crown is slightly longer that the space between adjacent strings. The weight holder has short centrally located sleeve providing a cup or socket for receiving a weight such a lead pellet. The weights can be small lead pellets that are pushed into the socket and firmly held in place by nibs on the weight or by closing the pocket with a covering portion. The lead pellets can be provided in varying weights to allow the amount of weight added to a particular portion of the a tennis racket to be varied.

The weighted holder is attached to the tennis racket by fitting an adjacent string into the slots on either side of the crown until the strings engage the bores and are locked on the tennis racket string. The weight can then be slid down on the strings until the small sleeve having the weighted socket is firmly abutting the inside surface of the frame forming the tennis racket head. The weight holder is made of a soft resilient synthetic or rubber like material. The amount of weight added to a tennis racket head can be varied by adding the weighted holder at various positions around the periphery of the frame securely attached to the tennis strings.

The above and other novel features and advantages of the invention will be more fully understood from the following detailed description and the accompanying drawings in which:

DETAILED DESCRIPTION OF THE INVENTION

Figures 1, 2, 3, 4, 5, 6, 7:
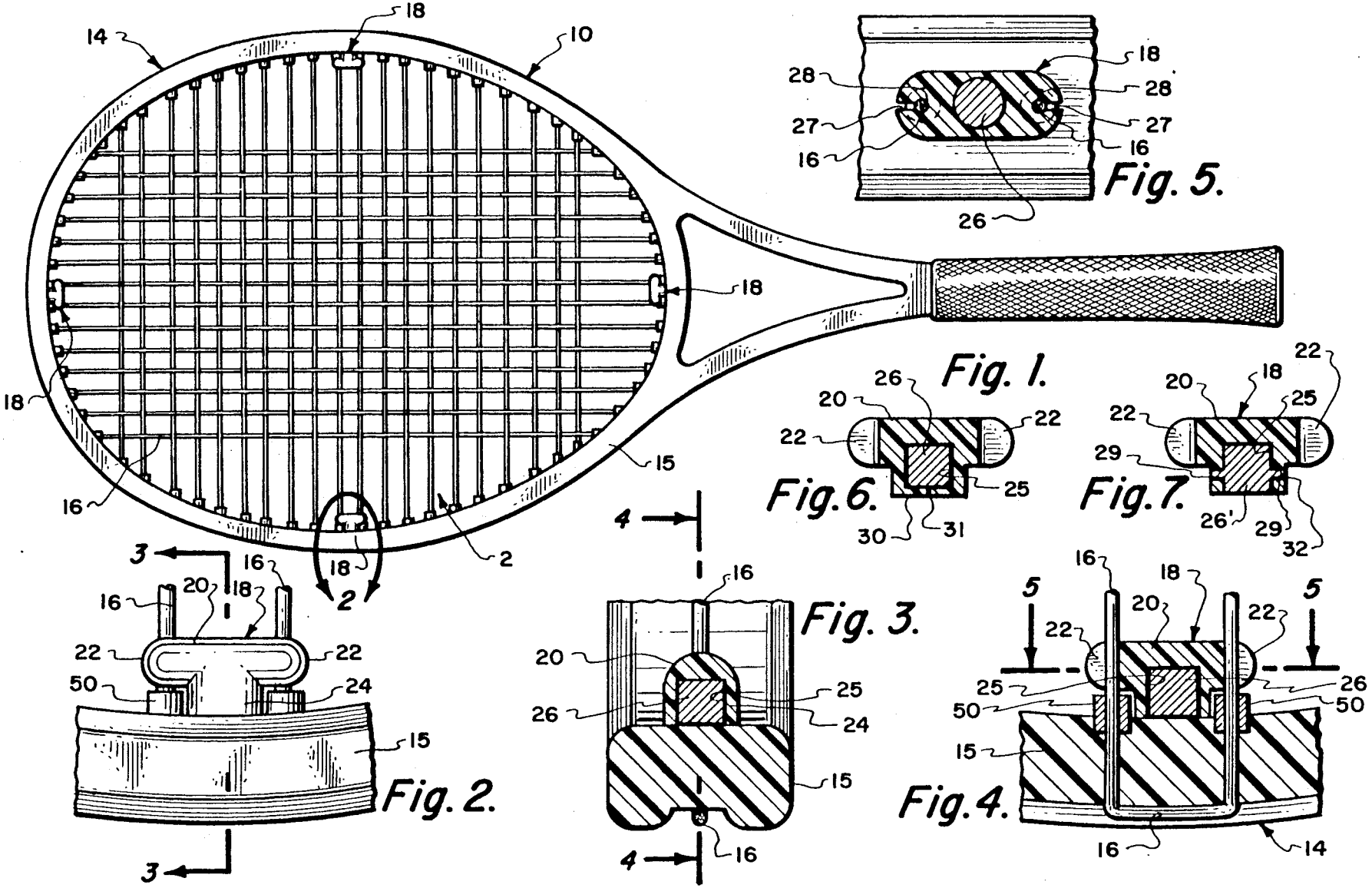
FIG. 1 is a side elevation of a conventional tennis racket having the snap-on weights attached according to the invention.
FIG. 2 is an exploded view of a portion of the tennis racket of FIG. 1 shown taken at 2 of FIG. 1.
FIG. 3 is a sectional view taken at 3—3 of FIG. 2.
FIG. 4 is a sectional view taken at 4—4 of FIG. 3.
FIG. 5 is a sectional view taken at 5—5 of FIG. 4.
FIG. 6 is a sectional view similar to FIG. 4 showing an alternate embodiment of the invention.
FIG. 7 is a sectional view similar to FIG. 4 showing a third alternate embodiment of the invention.
Figure 8:
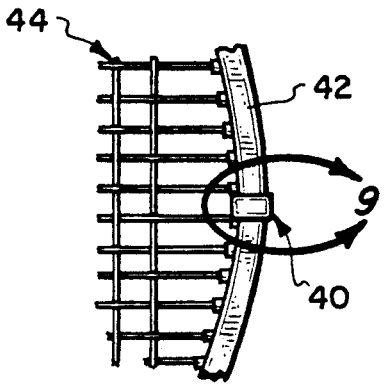
FIG. 8 is a partial view of a tennis racket showing the installation of an alternate embodiment according to the invention.

A conventional tennis racket 10 is illustrated in FIG. 1 which is comprised of a handle 12 and a head portion 14 having strings 16. The weight and balance of the tennis racket 10 is fixed by the manufacture and cannot be adjusted or changed. The only change that can be made in the racket is the replacement of strings 16 when one of the strings breaks. The present invention is comprised of snap-on weighted holder 18 that can be selectively spaced around the head to provide additional weight and increase the power with which a player hits the ball. Weighted holder 18 can be placed at any one of selected spaces between the strings indicated at 21 around the tennis racket head 14. Proper placement can give a different "feel" to a tennis racket to aid in providing a better swing with greater power.

A weighted holder is shown installed on strings 16 in FIG. 2. Weighted holder 18 is comprised of a crown 20 having an oblong shape and flanges 22 that attach to adjacent strings in the space 21 between adjacent strings. A sleeve 24 on the weight holder provides a socket for holding a lead weight or pellet 26.

The adjustable weight is attached to the tennis racket as illustrated in FIG. 5. Crown 20 of the weight holder 18 has slots 27 narrower than strings 16 terminating in bores 28 which are approximately equal to the diameter of tennis racket strings 16. Weight holder 18 is made of a resilient synthetic or rubber-like material allowing the slots 27 to be easily pried open by a string 16 which then snap onto bore 28 securely locking a weighted holder on the tennis racket. Before installing a weighted holder 18 on the tennis racket a lead weight or pellet 26 is inserted in cup or socket 25 formed on sleeve 24. Lead pellets 26 of varying weight can be inserted in the socket 25. This allows the player to vary the amount of weight being placed at selected positions around the tennis racket head 14.

As can be seen in FIG. 4, with lead pellet 26 securely positioned in the socket 25 in weight holder 18 the device can be attached to a tennis racket in selected spaces 21 between the adjacent strings with string 16 engaging the bores 28, securely locking the weighted holder on the racket. The weight 18 is then slid down on the strings until the sleeve 24 and the lead weight 26 is securely abutting frame 15 forming head 14 of the tennis racket.

Alternatively, lead pellet 26 can be securely held in the socket 25 by any of the methods shown in FIG. 6 or FIG. 7. In FIG. 6 socket 25 is closed by a layer of resilient material 30 forming weight holder 18 as shown. Alternatively covering 30 over the socket 25 can have crosswise slits 31 allowing a different weight lead pellet to be pushed through the covering into the socket to change the weight of weighted holder 18.

Another alternative shown in FIG. 7 is to provide small holes 32 in either side of the sleeve 24 forming pocket 25 for holding the lead pellet. Lead pellet 26' can then be formed with small nibs 29 on either side which engage holes 32 holding lead pellet 26' in sleeve 24.

Weighted holder 18 can be conveniently attached on the tennis racket around the head 14 to vary the weight and balance of the racket. Any arrangement of weights can be used as desired with a selected number of weights placed in one or more selected spaces between strings 16. The amount and placement of the weights can be determined by the player using the racket. Further, weights can be easily adjusted from one position to another by simply twisting the crown 20 to dislodge the strings from bores 28 and allowing them to slip out of slots 27. The weight can then be easily reinstalled at another position around the tennis racket head 14 wherever desired to change the balance.

Figure 9:
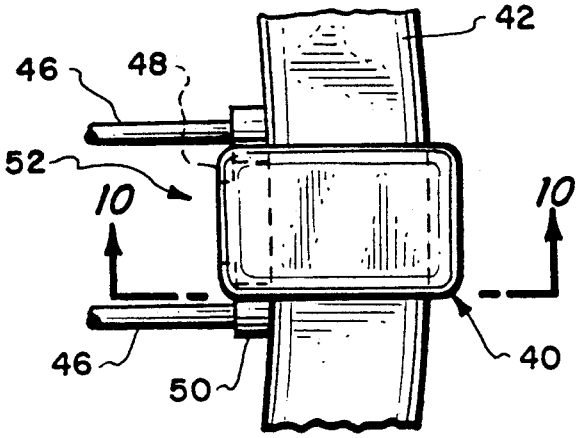
FIG. 9 is an enlarged detailed view taken at 9 of FIG. 8.
Figure 10:
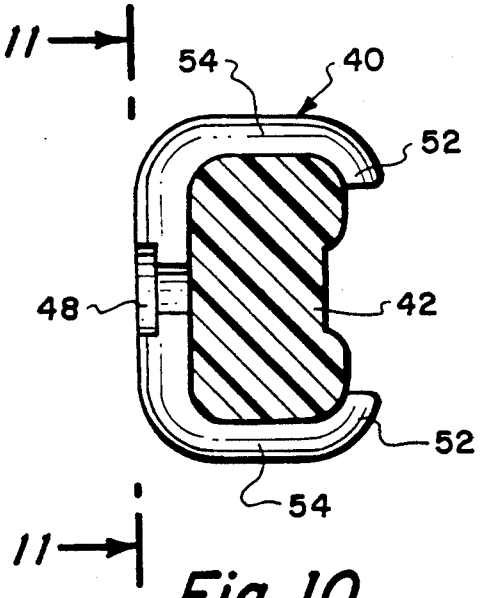
FIG. 10 is a sectional view taken at 10—10 of FIG. 9.

An alternate embodiment of the invention is illustrated in FIGS. 8 through 11. This embodiment also shows an easily attached balancing weight but is less preferred because it is bulkier and is less easy to vary the weights than the previous embodiment. In this embodiment, weighted clip 40 snaps around the frame 42 of a conventional tennis racket 44 partially shown in FIG. 8. Weighted clip 40 fits between strings 46 and has a indentation on either side 48 to accommodate string ferrules 50. Weighted clip 40 has a C-shape as illustrated in FIG. 10 and is shaped to fit around a substantially rectangular frame 42. The shape, of course, could be varied according to the shape of the frame of the racket 42. In some cases the racket frame is slightly oval in shape, in which case the clip 40 would have an oval conforming internal shape to match the racket frame.

Figure 11:
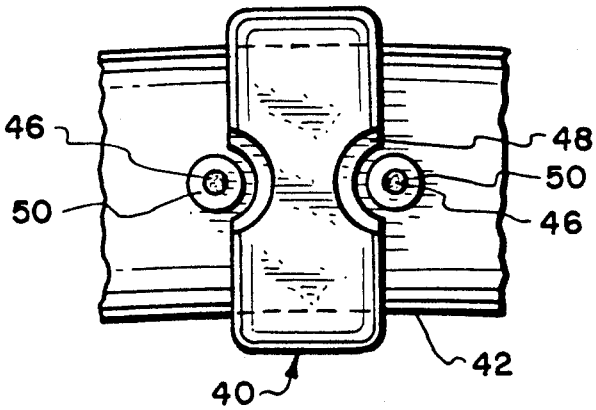
FIG. 11 is a view taken at 11—11 of FIG. 10.

Recess, or detent 48 allows the clip to easily fit in the space 52 between adjacent strings 46 at any selected location around the head of racket 44. Recesses 48 on either side of the clip-on weight 40 provide space for the ferrules 50 and strings 46. Any number, size and arrangement of weights can be clipped on the frame as shown in FIGS. 9 through 11. This allows the player to quickly change the size and location of the weight to suit his needs.

The recess 48 acts to prevent the clip from slipping off frame 42. The arms 54 of clips 40 curve around the frame 42 terminating at ends 52 which extend slightly around the corners of the racket frame 42. This prevents clips 40 from easily being dislodged from the frame.

The weight 42 can be constructed of a flexible metal that will easily snap around the frame or it can be a flexible metal with a resilient coating such as a synthetic, plastic or rubber-like material. This will prevent scarring of the tennis racket frame 42.

Thus, there has been disclosed a readily attachable weight for varying the weight and balance of a tennis racket. The weights can be easily mounted between the spaces between adjacent strings of a tennis racket and can be placed anywhere around the periphery of the tennis racket head.

This invention is not to be limited by the embodiments shown in the drawings and described in the description, which are given by way of example and not of limitation, but only in accordance with the scope of the appended claims.

What is claimed is:

1. Apparatus for varying the weight and balance of a tennis racket comprising;

weight fastening means for fastening a weight to the head of a tennis racket, said fastening means being constructed of a stiffly resilient material and having an oblong portion and a cylindrical portion, said oblong portion having flanges with perpendicular slots terminating in bores constructed to fit the strings of a tennis racket, said cylindrical portion constructed and arranged to fit between tennis racket strings in abutment with the frame of a tennis racket, said cylindrical portion having a socket for receiving a weight; removable weight means inserted in said socket; retaining means for retaining said removable weight means in said socket, said retaining means comprising at least two holes in the wall of said socket and corresponding projections on the sides of said removable weight means fitting said holes; whereby the weight and balance of a tennis racket may be varied by attaching one or more of said weight fastening means at selected positions around the frame of said tennis racket between said tennis racket strings.

2. The apparatus according to claim 1 in which different caliber weights may be placed at selected positions around said tennis racket frame.

3. The apparatus according to claim 1 in which the bore at the end of said slots is equal to or smaller than the diameter of the strings of said tennis racket.

4. Apparatus for varying the weight and balance of a tennis racket comprising;

weight fastening means for fastening a weight to the head of a tennis racket, said fastening means being constructed of a stiffly resilient material and having an oblong portion and a cylindrical portion, said oblong portion having flanges with perpendicular slots terminating in bores constructed to fit the strings of a tennis racket, said cylindrical portion constructed and arranged to fit between tennis racket strings in abutment with the frame of a tennis racket, said cylindrical portion having a socket for receiving a weight; removable weight means inserted in said socket; retaining means for retaining said removable weight means in said socket, said retaining means removably retaining said weight in said socket; whereby the weight and balance of a tennis racket may be varied by attaching one or more of said weight fastening means at selected positions around the frame of said tennis racket between said tennis racket strings.

5. The apparatus according to claim 4 wherein said retaining means comprises a displaceable cover over the entrance to said socket.

6. The apparatus according to claim 5 wherein said displaceable cover comprises; a resilient cover over the entrance to said socket; said cover being sectioned by slits to allow access to said socket through said cover; whereby different caliber weights may be installed in said socket.

7. The apparatus according to claim 4 in which the bore at the end of said slots is equal to or less than the diameter of the strings of a tennis racket.

* * * * *